US006932340B1

(12) United States Patent
Schaefer et al.

(10) Patent No.: US 6,932,340 B1
(45) Date of Patent: Aug. 23, 2005

(54) METHOD OF PLAYING A DICE WAGERING GAME

(75) Inventors: Craig M. Schaefer, Las Vegas, NV (US); Micheal S. Schneweis, Las Vegas, NV (US)

(73) Assignee: West Coast Gaming, Inc., Las Vegas, NV (US)

( * ) Notice: Subject to any disclaimer, the term of this patent is extended or adjusted under 35 U.S.C. 154(b) by 0 days.

(21) Appl. No.: 10/697,586

(22) Filed: Oct. 29, 2003

(51) Int. Cl.[7] ..... A63F 9/04
(52) U.S. Cl. ..... 273/146; 463/22
(58) Field of Search ..... 273/138.1, 146, 273/274, 309; 463/10, 11, 12, 13, 16, 22

(56) References Cited

U.S. PATENT DOCUMENTS 3,810,627 A * 5/1974 Levy ..... 463/26
4,506,890 A 3/1985 Murry
5,031,914 A 7/1991 Rosenthal
5,413,351 A * 5/1995 Franklin ..... 273/274
5,513,850 A * 5/1996 Vancura ..... 273/274
5,662,330 A * 9/1997 Spears ..... 273/274
5,806,847 A * 9/1998 White et al. ..... 273/309
5,984,779 A * 11/1999 Bridgeman et al. ..... 463/16
6,123,333 A * 9/2000 McGinnis et al. ..... 273/146
6,173,955 B1 1/2001 Perrie et al.
6,213,876 B1 4/2001 Moore, Jr.
6,305,686 B1 10/2001 Perrie et al.
6,336,860 B1 * 1/2002 Webb ..... 463/22
6,378,869 B1 * 4/2002 Hedge et al. ..... 273/274
6,394,901 B1 5/2002 Marta
6,435,505 B1 * 8/2002 Hoffman ..... 273/274
6,481,713 B2 11/2002 Perrie et al.
6,565,088 B2 5/2003 Perrie et al.
6,605,001 B1 * 8/2003 Tarantino ..... 463/22
6,746,016 B2 * 6/2004 Perrie et al. ..... 273/138.1
6,761,353 B2 * 7/2004 Berman et al. ..... 273/146
6,776,413 B2 * 8/2004 Brown, III ..... 273/146

* cited by examiner

*Primary Examiner*—Kurt Fernstrom
(74) *Attorney, Agent, or Firm*—Rob L. Phillips; Greenberg Traurig

(57) ABSTRACT

A wagering game utilizing multiple dice is disclosed. In an electronic gaming machine embodiment, a player causes five dice to be rolled a first time. The player then selects which dice to hold and discard and re-roll. The discarded dice are re-rolled and a sum of the five dice determines a payout. Larger payouts are provided for small and large sums with moderate sums resulting in losing wagers. Outcomes of five of a kind trigger a bonus round. Bonus rounds are played in similar fashion to non-bonus rounds. A system of tiered bonus rounds facilitate jackpots, including progressive jackpots. In an alternative bonus round embodiment, players are able to select a level of risk/reward related to a winning outcome. The player may select levels corresponding to conservative, aggressive and high-risk. A live table game version of the game is also implementable.

20 Claims, 6 Drawing Sheets

| TOTAL | 1ST COIN | 2ND COIN | 3RD COIN | 4TH COIN | 5TH COIN |
|---|---|---|---|---|---|
| 5 OR 30 | 50 | 100 | 150 | 200 | 250 |
| 6 OR 29 | 20 | 40 | 60 | 80 | 100 |
| 7 OR 28 | 10 | 20 | 30 | 40 | 50 |
| 8 OR 27 | 5 | 10 | 15 | 20 | 25 |
| 9 OR 26 | 4 | 8 | 12 | 16 | 20 |
| 10 OR 25 | 3 | 6 | 9 | 12 | 15 |
| 11 OR 24 | 2 | 4 | 6 | 8 | 10 |
| 12 OR 23 | 1 | 2 | 3 | 4 | 5 |

METHOD OF PLAYING A DICE WAGERING GAME

FIELD OF THE INVENTION

The embodiments of the present invention relate to a method of playing a dice wagering game.

BACKGROUND

The popularity of gaming has exploded during the last ten years. The result has been the consistent opening of new casinos throughout the United States and worldwide. In fact, casinos are opening at a record pace to keep up with the seemingly endless demand. The steady demand has also proliferated the creation of new wagering games.

One sector of gaming that has seen incredible growth is related to electronic gaming machines. Indeed, slot machines and video poker machines now generate more revenue than live table games. Based on the popularity of electronic gaming machines, casinos have apportioned a higher percentage of their floor space for the installation of electronic gaming machines.

Therefore, new electronic gaming machine concepts are being developed at an exhaustive pace. Unfortunately, to date, a vast majority of the new games have not found their way onto casino floors. The reasons for such failures typically relate to common wagering game shortcomings. Such shortcomings include complex rules, slow play and unappealing concepts. To intrigue the casinos, electronically implemented wagering games must be easy to play, quick to play and involve an attractive theme to lure players. A perfect example of a vastly successful electronic wagering game is video poker. Video poker offers players a simple game (i.e., draw poker), fast pace of play and the depiction of playing cards which most gamblers can immediately identify and readily understand.

Based on the lack of new practical gaming machines, there continues to be a need for new wagering games exhibiting the aforementioned characteristics which are implementable in an electronic gaming machine embodiment.

SUMMARY

Accordingly, the embodiments of the present invention provide a wagering game having the advantageous characteristics sought by casinos. More particularly, the embodiments of the present invention utilize dice to facilitate a wagering game having characteristics common to popular wagering games.

In an electronic gaming machine embodiment of the present invention, a processor, random number generator and display provide a vehicle for presenting a dice wagering game. The underlying concept of the game is to roll multiple dice one or more times and provide a pay table dependent upon the sum of the rolled dice and/or the outcome of the rolled dice.

In a first embodiment, the processor causes the display of five six-sided dice which are caused to be "rolled" by the processor. The player then has the option to hold the dice or to discard and re-roll one or more of the dice a second time. The decision regarding which dice to hold and which dice to discard is influenced by a pay table which includes payouts for large dice sums, small dice sums and/or five dice having the same face value. For example, if the sum of the five dice after the first roll is small, the player may elect to discard and re-roll all dice having a high value thereby hoping to lower the sum of the five dice (i.e., go low) and receive a preestablished payout. Subsequent to the second roll, the processor automatically provides the player with any earned payouts. It is understood that players may be provided with multiple opportunities to hold dice and re-roll discarded dice.

Other embodiments of the present invention include bonus rounds which provide payouts in addition to the primary game. One such bonus round is triggered in response to a player receiving five dice of the same value during the primary game. The bonus round then proceeds with the same rules as the primary game but the payouts may be adjusted to reflect a higher winning frequency.

Other embodiments, modifications and variations are evident from the corresponding drawings, detailed description and claims as set forth herein.

DETAILED DESCRIPTION

Figure 1:
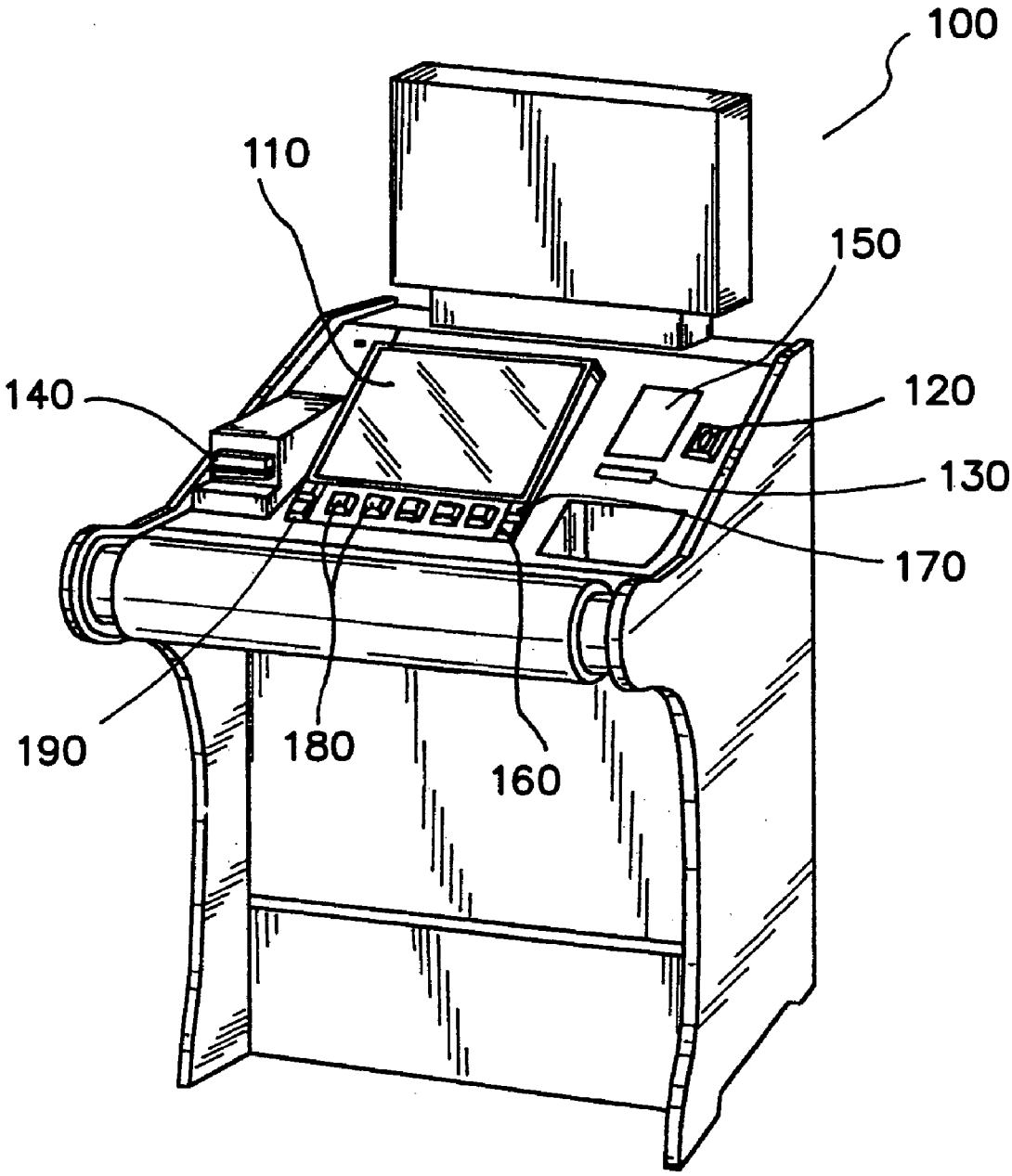
FIG. 1 illustrates an electronic gaming machine of the kind which can be used to facilitate the embodiments of the present invention.

Reference is now made to the figures wherein like parts are referred to by like numerals throughout. FIG. 1 illustrates a gaming machine 100 which can be used to facilitate the electronic wagering game embodiments of the present invention. The operation of electronic gaming machines, including slot machines and video poker machines, is well known in the industry so that the minute details are not set forth herein. In general terms, electronic gaming machines are controlled by processors including, or in communication with, a random number generator. The random number generator provides random machine outcomes. In this case, the simulated rolls of the dice. A display in communication with the processor provides visual and graphic information to players. The processor then controls the game, including the tracking of wagers and payouts.

The general external features of the gaming machine 100, include a display 110, coin slot 120, a bill reader 130, a card reader 140 and a credit display 150. The gaming machine 100 also includes several player buttons which act as interfaces between the player and the machine processor. Player buttons include a one coin wager button 160, a maximum coin wager button 170, hold and discard buttons 180 and a roll the dice button 190. While not shown, the machine 100 may also incorporate a ticket dispenser for printing tickets for redemption at a cashier window. Such cashless systems are becoming increasingly popular in most gaming jurisdictions. It is noted that any of the functions facilitated by the gaming machine buttons 160–190 can be performed by a display employing touchscreen technology.

Figure 2:
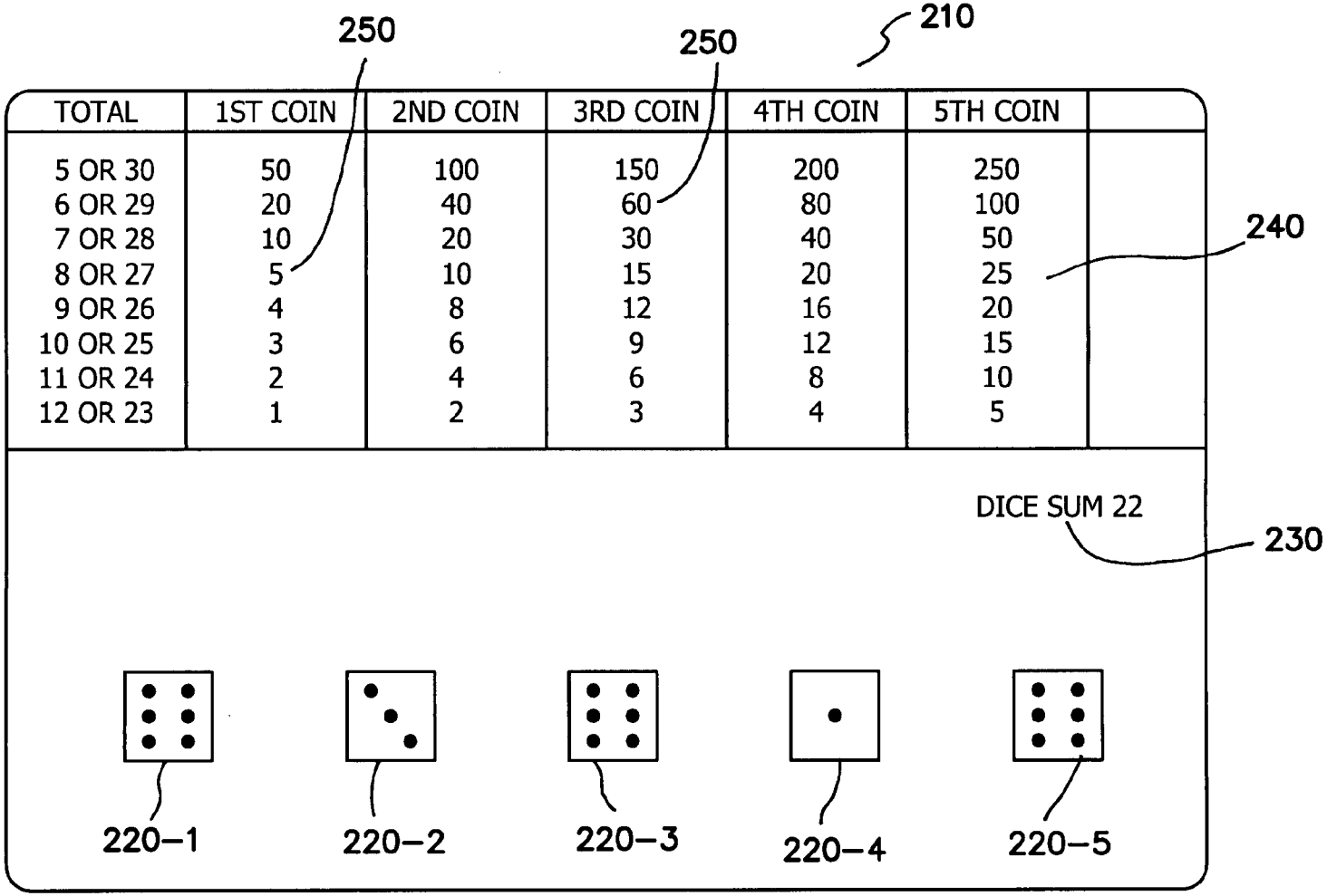
FIG. 2 illustrates a first screen of a display of an electronic gaming machine embodiment of the present invention after a first roll.

Now referring to FIG. 2, a first screen 210 of display 110 depicts five simulated dice 220-1 through 220-5, a dice sum 230 of 22 and a pay table 240. The five six-sided dice 220-1 through 220-5 are shown on the screen 210 after a first roll of the dice. As known to those skilled in the art, the roll of the dice is simulated by the processor in conjunction with the random number generator. At screen 210, the player has the option of holding or discarding and re-rolling any number of the dice 220-1 through 220-5. The decision to hold or discard and re-roll the dice is influenced by the pay table 240 as explained below.

While five conventional dice are used herein to illustrate the embodiments of the present invention, the number of dice, number of sides per dice and/or number of rolls may be altered to change the complexity of the game as desired. For example, four twelve-sided dice may be used to achieve the same objective as the hereinafter described game played with five six-sided dice. In addition, players may roll the dice three or more times.

The payouts 250 set forth in pay table 240 are displayed in columns related to the number of coins played. That is, the more coins played (i.e., wagered), the more the corresponding payout 250. Ideally, the payouts 250 are directly related to the sum of the five dice after two rolls. For example, if the five dice after two rolls have a sum of twelve or twenty-three, the corresponding payout is five coins for five coins played. As indicated above, more than two rolls of the dice are contemplated herein. The payouts 250 increase to their maximum level when maximum and minimum dice sums are achieved. In other words, a five dice sum of five (i.e., five ones) or thirty (i.e., five sixes) pays two hundred and fifty coins for five coins played. More common sums of thirteen through twenty-two result in a loss for the player. It is understood that other sums can correspond to payouts. That is, the pay table 240 is illustrative only and does not limit the scope of the possible payout schemes available. Although not shown, it is contemplated that a payout may be associated with the five dice having an identical value (e.g., five threes) or being in succession (e.g., 2, 3, 4, 5 and 6).

Figure 3:
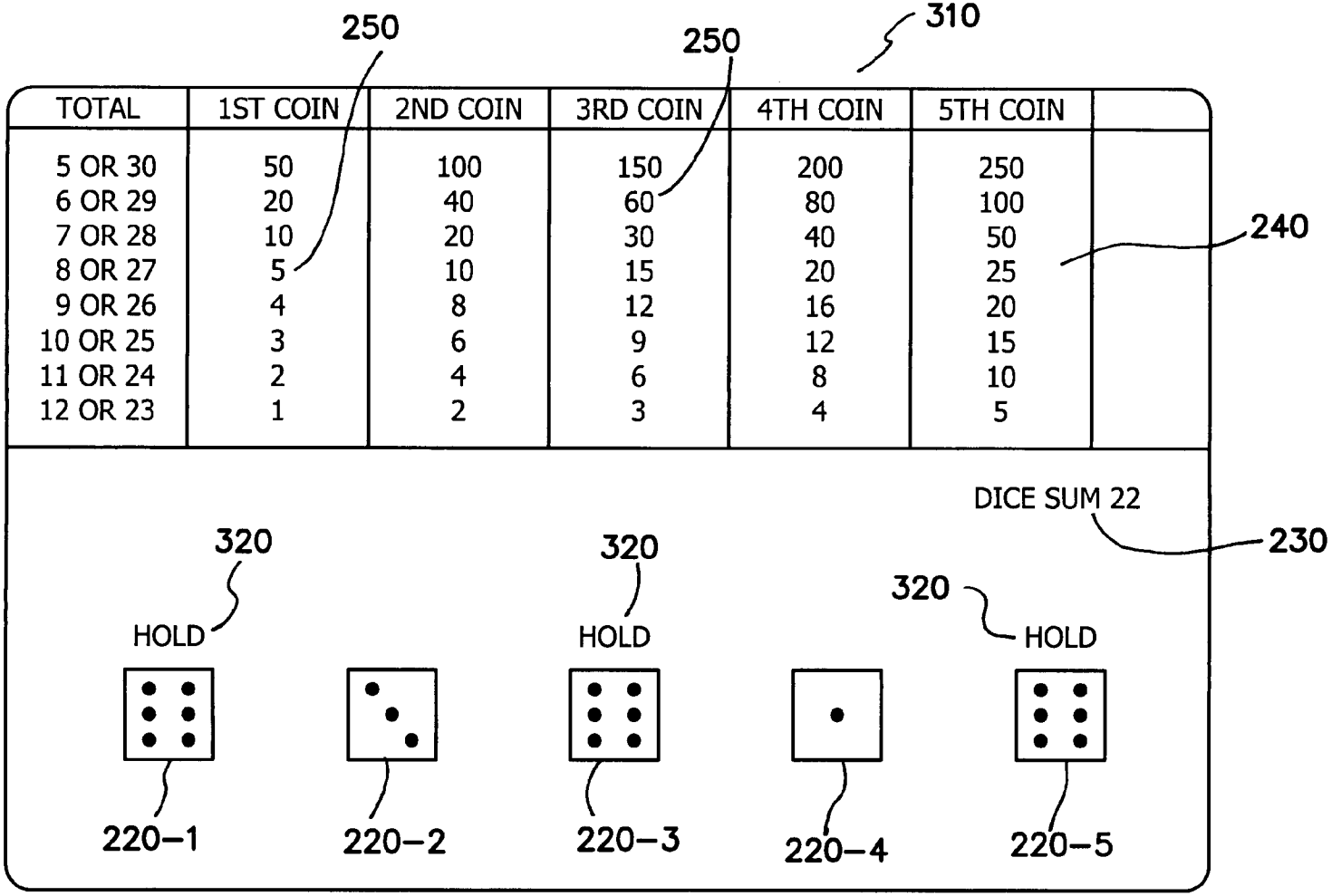
FIG. 3 illustrates a second screen of a display of an electronic gaming machine embodiment of the present invention after the player has selected which dice to hold and which dice to discard.

FIG. 3 shows a second screen 310 of display 110 indicating which dice the player has decided to hold and discard. Accordingly, above dice 220-1,220-3 and 220-5 is an indicator 320 showing that the corresponding dice 220-1, 220-3 and 220-5 are being held and dice 220-2 and 220-4 are being discarded and re-rolled. While the indicator 320 is the word "HOLD" displayed above the dice being held, other indicators include the dice changing colors, the dice being moved into a hold area, etc. As shown in FIG. 2, the player has elected to pursue a high sum. Depending on the values of the dice, the player may elect to pursue a low sum as well. In fact, with regard to the instant example, the player may elect to hold die 220-4 and pursue a low sum. Of course, the probabilities weigh against the player since four dice 220-1, 220-2, 220-3 and 220-5, rather than two, must be re-rolled.

Figure 4:
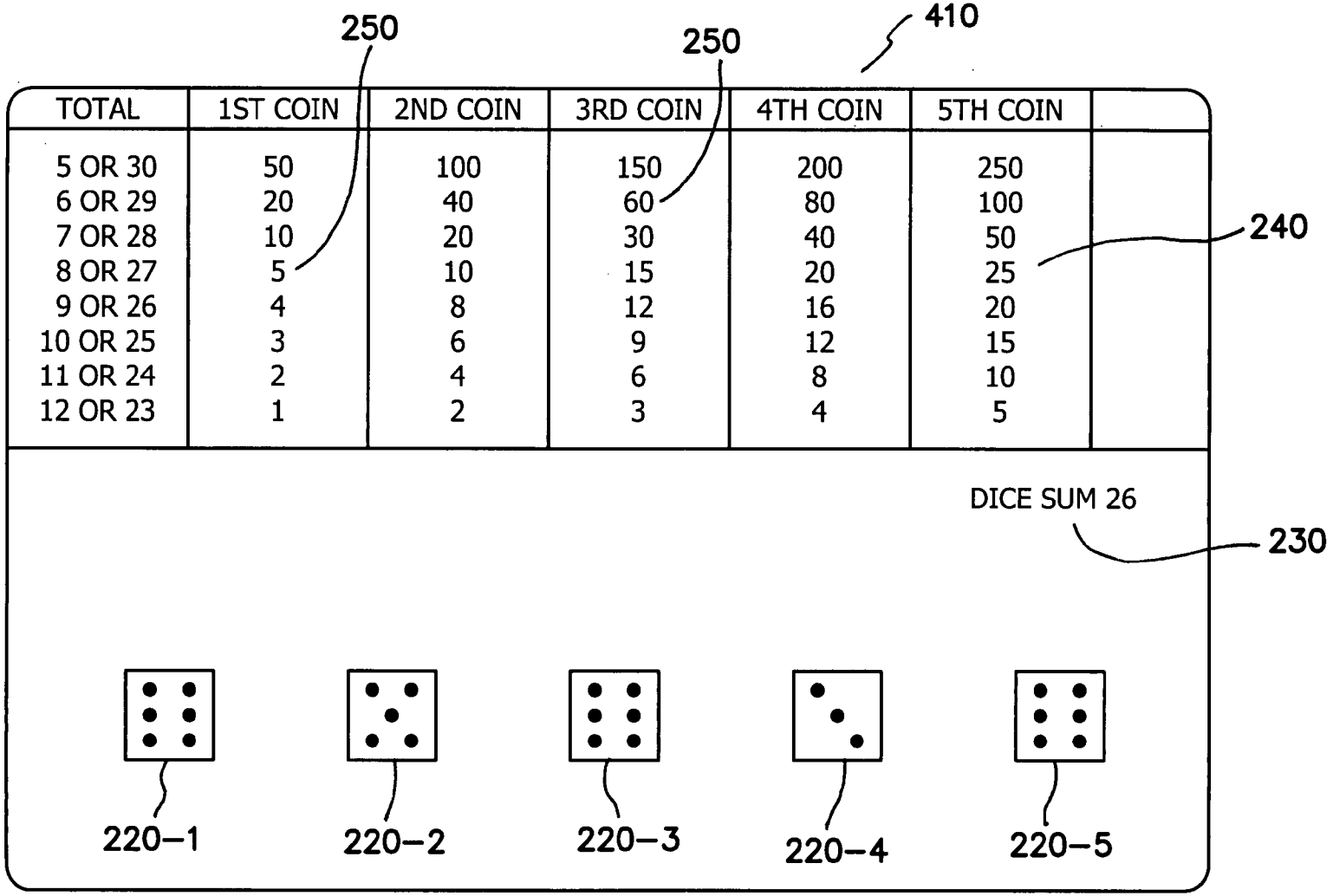
FIG. 4 illustrates a third screen of a display of an electronic gaming machine embodiment of the present invention after a second roll.
Figure 5:
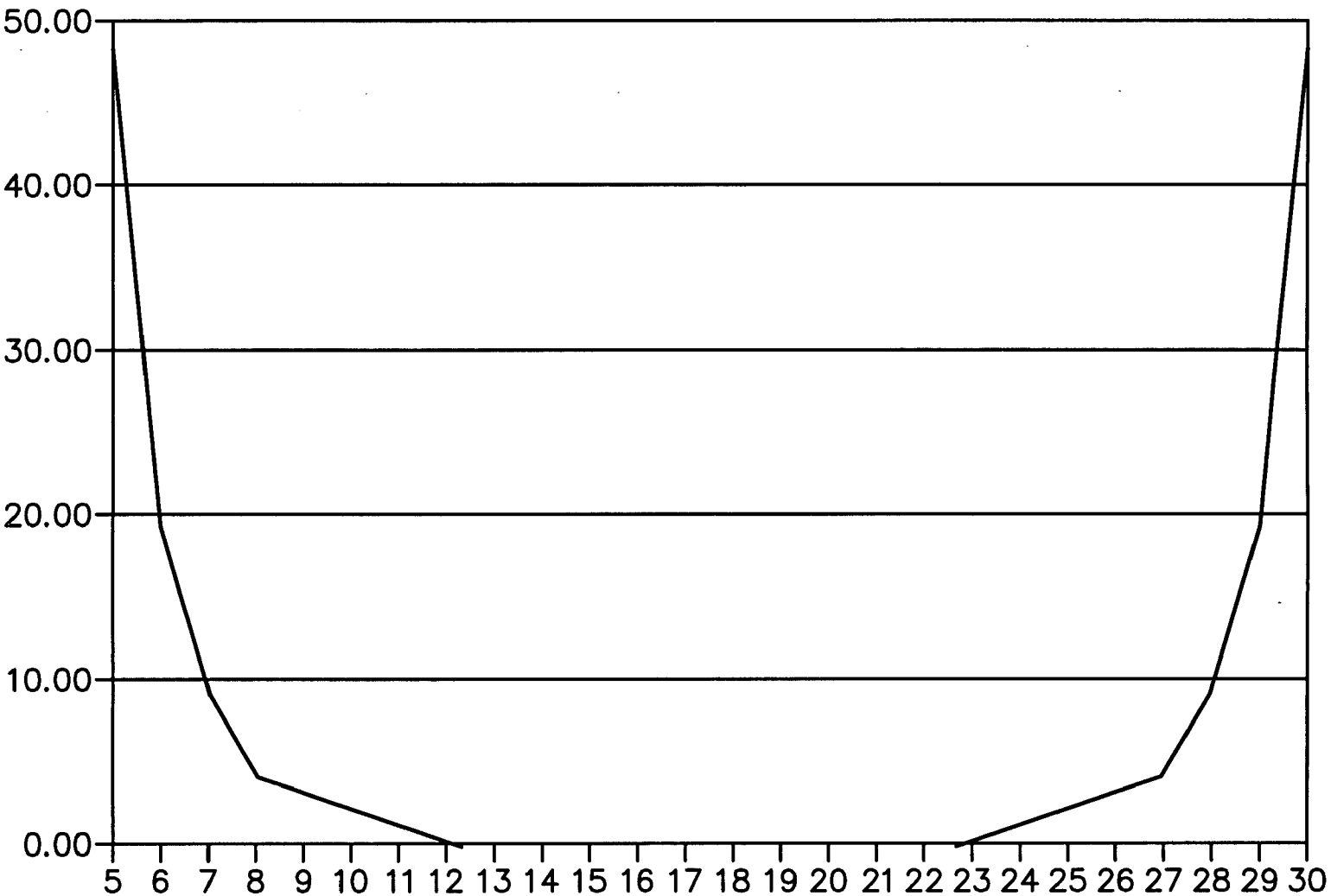
FIG. 5 illustrates a graphical representation of one set of payouts.

FIG. 4 shows a third screen 410 of display 110. As illustrated, dice 220-2 and 220-4 have been re-rolled to reveal dice 220-2 and 220-4 with new values. The total dice sum 320 is now 26 as opposed to 22 as it was after the first roll. Accordingly, as set forth in the pay table 240 the player receives twenty coins for a five coin wager. FIG. 5 shows a graphical representation of the payout scheme shown in FIGS. 2–4. As mentioned herein other payout schemes are possible.

In an alternative embodiment, two or more groups of five dice are initially displayed. The player may place a wager with respect to as many of the dice groups as desired. The player then causes a first group of five dice to be rolled and selects which dice to hold and discard. The held dice of the first group are transposed to each of the other groups of five dice having a wager thereon. In this manner, the player has two or more dice groups with the same held dice. Then, the player causes the non-held dice in each group to be rolled. Each dice group roll is independent of the other and is randomly decided so that the player ends with two or more unique groups (it is noted that one or more of the dice groups may, by chance, hold the identical dice values after the non-held dice are rolled). The player may then receive a payout for each dice group sum having a corresponding wager and may also be advanced to a bonus round based on each dice group sum or dice values.

Figure 6:
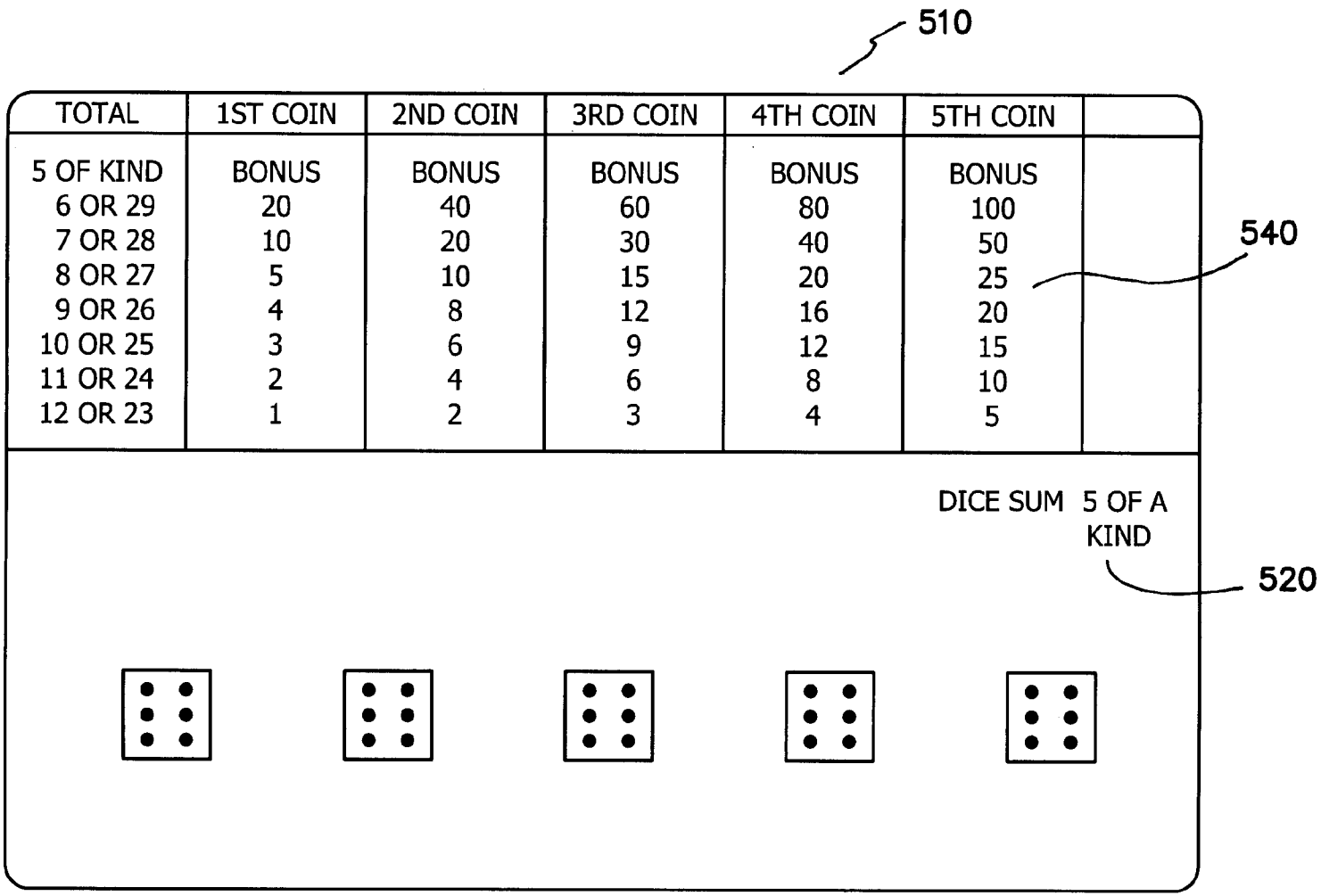
FIG. 6 illustrates a bonus screen of a display of an electronic gaming machine embodiment of the present invention.

An integral component of many new wagering games is the inclusion of a bonus and/or jackpot. The embodiments of the present invention lend themselves to any number of bonus and/or jackpot features. In a first bonus embodiment, a bonus round is triggered in response to a player receiving five dice of identical face value after a first or second roll of the primary game. FIG. 6 illustrates a bonus screen 510. The dice sum 520 now reads "5 of a Kind" to indicate that the bonus round is being activated as set forth in the pay table 540. The bonus round then proceeds in a manner identical to the play of the non-bonus rounds. That is, during the bonus round, the player causes the dice to be rolled one or more times with the player able to hold and discard selected dice prior to a second roll. The bonus payouts may be different than the primary game payouts but continue to relate to the sum of the dice.

Another feature of the first bonus round is the ability of the player to select the probabilities of winning. That is, the player may select a conservative, aggressive or high-risk form of the game. With each selection, differing payouts correspond to identical outcomes. In otherwords, conservative game payouts are the least generous, high-risk payouts are the most generous and aggressive payouts fall in-between. This feature allows the player to dictate the potential payouts.

Like the first embodiment of a bonus round, a second bonus embodiment, is triggered in response to a player receiving five dice of identical face value after a first or second roll of the dice during the primary game. However, in the second embodiment, the number of rounds played during the bonus round is determined by the roll of the dice. Initially, the player is provided with a first roll after which the player may hold and discard dice accordingly. The second roll is then completed. The sum of the second roll dictates the number of bonus rounds to be played. For example, the sum may equal the number of rounds or the sum may be some factor of a corresponding number of rounds as set forth in a bonus table or the like.

In a third embodiment, one or more bonus rounds lead to an opportunity to win a large progressive jackpot. Progressive jackpots are derived from the incremental collection of a small percentage of each wager received by each of a plurality of linked or networked gaming machines. For example, MegaBucks®) is a network of 691 gaming machines, located throughout Las Vegas, which provide a progressive jackpot in excess of $7,000,000 and has the distinction of having awarded a player a world record amount in excess of $39,000,000. The networked machines do not have to be so extensive and can include only machines in a common bank or casino property. These types of progressive jackpots are extremely popular and encourage extensive play.

In the third embodiment, a first five of a kind bonus round proceeds according to the rules of the bonus round of the first embodiment. That is, a player is advanced to the bonus round in response to obtaining five of a kind on a first or second roll of the dice during the primary game. The first bonus round comprises the player, on one or more occasions, rolling the dice a first time, selecting which dice to hold and discarding and re-rolling the discarded dice a second time. Based on the sum of the dice after the second roll, the player may receive a payout. Should the player roll a final sum of 6, 7, 28 or 29 the player is advanced to a second bonus round. It is understood that other sums may also advance the player to a successive bonus round. If the player rolls a five of kind, the player is advanced to a second five of a kind bonus round as described below.

The second bonus round includes two separate divisions. A first division of the second bonus round is triggered in response to the player rolling a sum of 7 or 28 in the first five of a kind bonus round. The first division of the second bonus round comprises two rounds of play. Smaller progressive jackpots are available for receiving sums of 6, 7, 8, 27, 28 or 29 during the two rounds of play. Should the player receive another five of a kind, the player advances to the second five of a kind bonus round of play as described in more detail below.

A second division of the second bonus round is triggered in response to the player receiving a sum of 6 or 29 in the first five of a kind bonus round. The second division of the second bonus round comprises three rounds of play. Smaller progressive jackpots are available for receiving sums of 6, 7, 8, 9, 10, 25, 26, 27, 28 or 29 during the three rounds of play. Should the player receive another five of a kind, the player advances to the second five of a kind bonus rounds of play as described in more detail below.

The second five of a kind bonus round comprises five rounds of play. Each round is played like the primary game. Jackpots correspond to each round and a larger progressive jackpot is based on the player receiving a preestablished number of five of a kinds (e.g., 3) during the second five of a kind bonus round. Accordingly, the progressive jackpot can become very significant based on the number of networked machines and the odds of receiving the necessary progressive jackpot outcomes.

Although an electronic gaming machine is ideal for facilitating the embodiments of the present invention, the game can also be played in a live table version. In such an embodiment, players roll physical dice and identify the dice to be held and to be discarded. A dealer then separates and retains the dice to be held and passes the discarded dice back to player. After a second or final roll, the dealer determines the appropriate payout, if any. The bonus rounds and progressive jackpots are equally implementable in the live version.

Additionally, the embodiments of the present invention are applicable to Internet gaming and local area network applications. That is, a server or central computer disseminates the game to one or more remotely connected terminals such that multiple players may play individual games by using terminals in communication with the server. The communication of the terminals with the server or central computer may be facilitated via hard wiring or wireless technology as known to those skilled in the art. The terminal acts in a manner consistent with the gaming machine embodiment described above but the application of the game is accessed at a central location (e.g., server or central computer) rather than at the local gaming machine level (i.e., machine processor). The player interfaces with the server-based game via a terminal keyboard, mouse, touchscreen or similar device. In such applications, wagers are typically placed using credit cards or other online payment devices.

While specific payouts, bonus triggers and bonus outcomes have been described herein, other payouts, triggers or outcomes are available without departing from the spirit and scope of the present invention.

It is to be understood that even though numerous characteristics of the present invention have been set forth in the foregoing description, together with an explanation of various possible embodiments and modifications thereto, this disclosure is illustrative only and changes may be made within the spirit of the invention to the full extent indicated by the broad general meaning of the terms in which the appended claims are expressed.

We claim:

1. A method of playing a wagering game comprising:

accepting a player wager, said player wager a single high-low wager which corresponds to both a pre-established range of low sums and pre-established range of high sums;

allowing a player to cause two or more dice to be rolled a first time;

allowing the player to either hold or discard each of the rolled dice in an effort to obtain either the high sum or low sum;

allowing the player to cause the discarded dice to be rolled at least one time; and resolving said wager based on a sum of the held and re-rolled dice, said wager being resolved as a winning wager if said sum of the held and re-rolled dice falls within the pre-established range of low dice sums or pre-established high dice sums.

2. The method of claim 1 further comprising advancing said player to one or more bonus rounds in response to the two or more dice each having identical values after a final roll.

3. The method of claim 2 further comprising the player selecting one of multiple pay tables corresponding to playing the bonus rounds wherein the pay tables are each based on differing levels of risk and differing payouts.

4. The method of claim 1 further comprising advancing a player to one or more progressive jackpot rounds in response to pre-established dice outcomes.

5. A method of playing a wagering game comprising:

accepting a player wager, said player wager a single high-low wager which corresponds to both a pre-established range of low sums and pre-established range of high sums;

allowing a player to cause five six-sided dice to be rolled a first time;

allowing the player to either hold or discard each of the five rolled dice in an effort to obtain the high sum or low sum;

allowing the player to cause the discarded dice to be rolled at least one time; and resolving said wager based on a sum of the held and re-rolled dice, said wager being resolved as a winning wager if said sum of the held and re-rolled dice falls within the pre-established range of low dice sums or pre-established high dice sums.

6. The method of claim 5 further comprising advancing said player to one or more bonus rounds in response to the two or more dice each having identical values after a final roll.

7. The method of claim 5 wherein the range of low dice sums correspond to 5 through 12, inclusive, and the range of high dice sums correspond to 23 through 30, inclusive.

8. The method of claim 6 further comprising the player selecting one of multiple pay tables corresponding to playing the bonus rounds wherein the pay tables each include different payouts related to varying levels of reward.

9. The method of claim 8 wherein the pay tables comprise a conservative, aggressive and high-risk version.

10. The method of claim 5 further comprising advancing a player to one or more progressive jackpot rounds in response to pre-established dice outcomes.

11. A wagering game comprising:

a gaming table for rolling dice, said table having a gaming layout;

two or more dice; and a wagering area depicted on said layout wherein players may place wagers, being single high/low wagers which correspond to both a pre-established range of low sums and pre-established range of high sums calculated subsequent to a pre-established number of rolls wherein after each roll a player may select which dice to hold and discard such that only discarded dice may be rolled again, said wagers being resolved as winning wagers if said sum of the held and re-rolled dice falls within the pre-established range of low dice sums or pre-established high dice sums.

12. The wagering game of claim 11 wherein five six-sided dice are rolled and the range of winning low dice sums is 5 through 12, inclusive, and the range of winning high dice sums is 23 through 30, inclusive.

13. An electronic gaming machine comprising:

a machine processor;

a player interface;

a display in communication with said processor, said display for displaying processor produced simulated rolls of two or more dice; and means for accepting a wager, said wager being a single high-low wager which correspond to both a pre-established range of low sums and pre-established range of high sums calculated subsequent to a pre-established number of rolls of the two or more dice wherein after each roll a player may select which dice to hold and discard such that only discarded dice may be rolled again, said wager being resolved as a winning wager if said sum of the held and re-rolled dice falls within the pre-established range of low dice sums or pre-established high dice sums.

14. The gaming machine of claim 13 wherein the display employs touchscreen technology.

15. A method of playing a wagering game comprising:

accepting a player wager, said player wager a single high-low wager which corresponds to both a pre-established range of low sums and pre-established range of high sums;

permitting the player to roll two or more dice one or more times;

permitting the player to hold any number of the rolled dice after each roll and permitting the player to re-roll the dice not held in an effort to obtain the high sum or low sum; and resolving said player wager according to a pay table setting forth payouts corresponding to a pre-established range of low dice sums and high dice sums of the two or more dice after a final roll said wager being resolved as a winning wager if said sum of the held and re-rolled dice falls within the pre-established range of low dice sums or pre-established high dice sums.

16. The method of claim 15 wherein five six-sided dice are rolled and the range of winning low dice sums include 5 through 12, inclusive, and the range of winning high dice sums include 23 through 30, inclusive.

17. A computer network, including a plurality of terminals in communication with one or more central computers, for facilitating play of a wagering game comprising;

a wagering game program stored on the one or more central computers;

a terminal having a display for displaying processor produced simulated rolls of two or more dice, said terminal further having a player interface for a player to play said wagering game; and means for accepting a wager said wager being a single high/low wager which corresponds to both a pre-established range of low sums and pre-established range of high sums calculated subsequent to a pre-established number of rolls of the two or more dice wherein after each roll a player may select which dice to hold and discard such that only discarded dice may be rolled again, said wagers being resolved as a winning wager if said sum of the held and re-rolled dice falls within the pre-established range of low dice sums or pre-established high dice sums.

18. A method of playing a wagering game comprising:

accepting a player wager on two or more dice groups;

allowing a player to cause five six-sided dice from a first dice group to be rolled a first time;

allowing the player to either hold or discard each of the five rolled dice from the first dice group;

placing in each dice group the dice values held in the first dice group such that each dice group has the same held dice values after the first roll of the first dice group;

allowing the player to cause the non-held dice of each dice group to be rolled; and resolving said wager on each dice group dependent upon a sum of the five dice in each dice group.

19. A method of playing a wagering game comprising:

providing multiple pay tables comprising different payouts and different numbers of winning outcomes, each said pay table having one or more common winning outcomes;

allowing a player to select one of said multiple pay tables;

accepting a player wager, said player wager a single high-low wager which corresponds to both a pre-established range of low sums and pre-established range of high sums;

allowing a player to cause two or more dice to be rolled a first time;

allowing the player to either hold or discard each of the rolled dice in an effort to achieve the high total or low sum;

allowing the player to cause the discarded dice to be rolled at least one time; and resolving said wager based on a sum of the held and re-rolled dice, said wager being resolved as a winning wager if said sum of the held and re-rolled dice falls within the pre-established range of low dice sums or pre-established high dice sums.

20. The method of claim 19 wherein said multiple pay tables comprise at least conservative, aggressive and high risk version.

* * * * *